US006113186A

United States Patent [19]

Holmes et al.

[11] Patent Number: 6,113,186

[45] Date of Patent: Sep. 5, 2000

[54] MULTIPLE SEAT ASSEMBLY I

[75] Inventors: Lester Holmes, Southhaven, Miss.; Gregory Saul, Charlotte, N.C.

[73] Assignee: Chromcraft/Revington Company, Senatobia, Miss.

[21] Appl. No.: 09/316,875

[22] Filed: May 21, 1999

[51] Int. Cl.[7] ..... A47C 15/00

[52] U.S. Cl. ..... 297/248; 297/440.11; 297/452.2; 297/452.56

[58] Field of Search ..... 297/440.11, 452.56, 297/452.63, 452.18, 452.19, 452.2, 248

[56] References Cited

U.S. PATENT DOCUMENTS 2,914,115 11/1959 Cameron ..... 297/248

4,848,843 7/1989 Gibbs ..... 297/248

5,393,126 2/1995 Boulva ..... 297/440.11

*Primary Examiner*—Anthony D. Barfield

*Attorney, Agent, or Firm*—Wolf, Greenfield & Sacks, P.C.

[57] ABSTRACT

A sling-type chair includes flat oval tubing contoured for proper lumbar support and knee strain relief. The tubing is disposed inside the sling fabric. The tubing on the sides are joined by stretchers. The connection between the stretchers and the tubing include inserts within the tubing and sockets outside the tubing that are joined together by bolts that extend through holes in the sockets and screwed into threaded holes in the inserts to effectively eliminate bending moments on the bolts.

9 Claims, 5 Drawing Sheets

MULTIPLE SEAT ASSEMBLY I

BACKGROUND

This invention relates to multiple seating of the type commonly used in airports, lounges and other waiting areas that service large numbers of people, and more particularly the invention relates to a new and improved construction for such seating.

Multiple seating assemblies used in such places as airports, train stations etc. are subjected to very heavy wear and abuse necessitating frequent repair. An important object of the present invention is to provide a multi-seating assembly that is capable of withstanding such use and abuse while maintaining a long, useful life and providing a high measure of comfort to the user.

Multiple seating assemblies are often used in substantial numbers, and the space available requires that the assemblies be capable of being assembled in different configurations so as to make maximum use of the space provided. Typically, different combinations of chairs and tables are required to maximize the capacity of the area and the comfort of those using the facility. The multi-seat assembly of this invention can be tailored to the requirements of the facility in which it is to be used. More particularly, the multiple seating furniture may be assembled with one or many chairs and/or with one or more tables dictated only by the intended use of and setting for the furniture.

SUMMARY OF THE INVENTION

The multiple seating furniture embodying this invention is comprised of a frame having a horizontal rail supported at each end by a vertical tubular post. All of the seats and tables included in the assembly are hung on the horizontal rail.

To connect the rail to the posts, a hole is provided in each post adjacent the top thereof, sized to receive an end of the rail. Immediately below the hole an L-shaped bracket is welded or otherwise attached to the post with a horizontal arm of the bracket disposed in the plane of the bottom edge of the hole so as to lend support to the end of the rail disposed in the hole, and a bolt which extends through the horizontal arm screws into a threaded opening in the bottom of the rail to secure the rail in place. In addition, a rigid cap employed to close the upper end of the tubular post carries a bolt that extends vertical into the post and screws into the rail to further secure the rail and post together.

Each chair and table is hung on the rail by means of an inverted U-shaped bracket that straddles the rail. To eliminate noise caused by metal to metal contact and afford tolerance in the fit of the bracket on the rail, a polymeric sheet material, preferably an ultra high molecular weight polyethylene, is disposed between the rail and U-shaped bracket. The clamping action of the brackets on the rail is enhanced by bolts that extend through the legs of the brackets and through the rail.

Each seat assembly includes a generally L-shaped plate that supports both the seat and the backrest. Each leg of the plate carries a pair of horizontal stretchers that support at their ends flat oval tubing contoured to impart both lumbar support and knee strain relief to the sling seat and backrest that they support. The connections between the ends of the stretchers and the flat oval tubing are made by threaded inserts preferably brazed in place in the tubing and by attachment sockets welded to the ends of the stretchers. The mating surfaces of the sockets, tubing and inserts are contoured to cause the parts to seat firmly against one another, and long bolts extend through the sockets and inserts to lock the assembly together. As will be evident from the detailed description this construction effectively eliminates bending moments on the bolts caused by one sitting in a seating unit.

These and other objects and features of the invention are accomplished by the multiple seating assembly described in detail below and shown in the accompanying drawing.

BRIEF FIGURE DESCRIPTION

DETAILED DESCRIPTION

Figure 1:
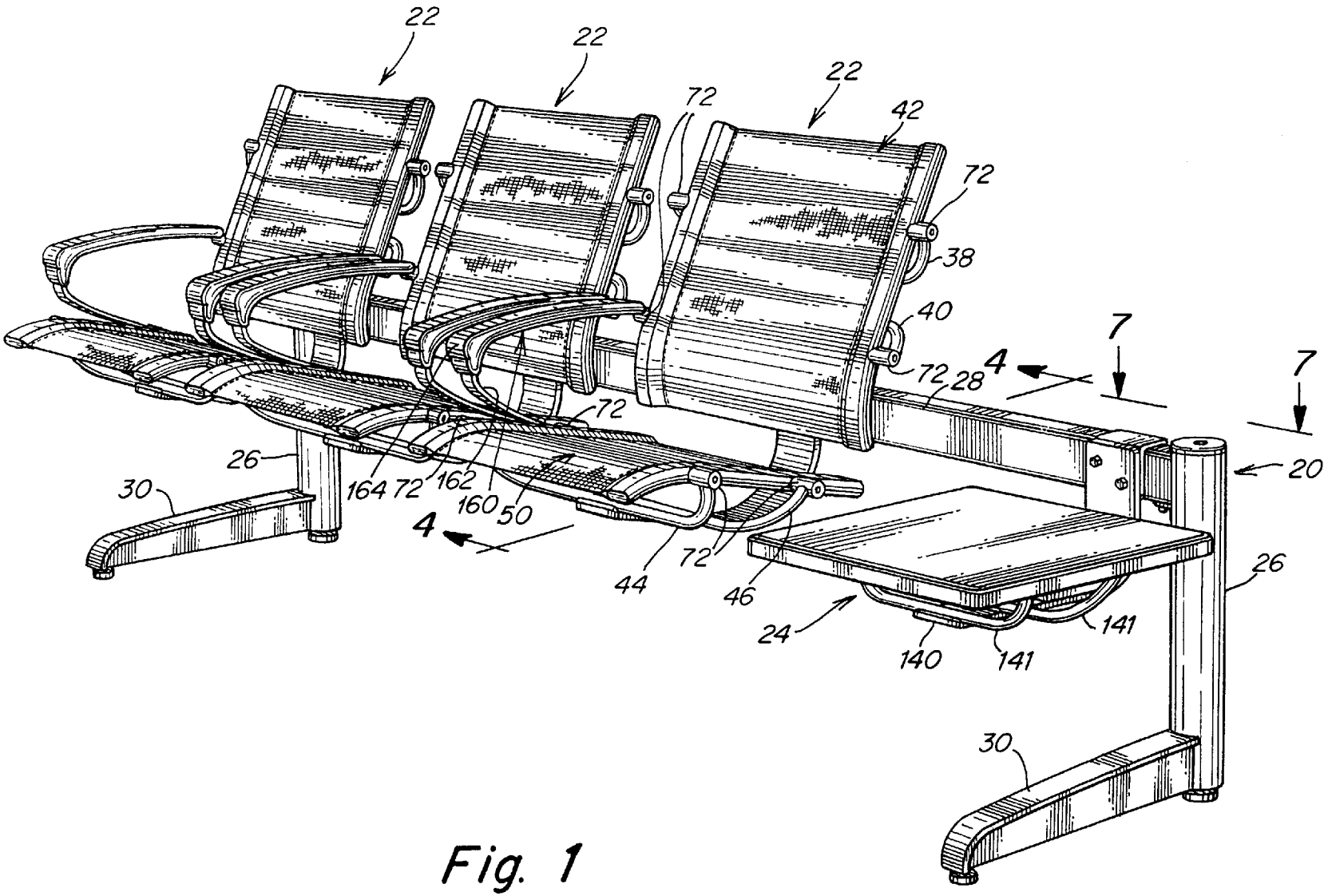
FIG. 1 is a front perspective view of a multiple seating assembly constructed in accordance with this invention.

The multiple seating assembly shown in the drawings includes a frame 20 on which are mounted a number of chairs 22 and a table 24. While in the embodiment illustrated three chairs 22 and a single table 24 are shown, it is to be understood that the assembly may include fewer or more chairs and tables (typically two to five chairs and one or two tables). The invention is not in any way limited to any one of those different configurations but rather includes all of them.

Figure 4:
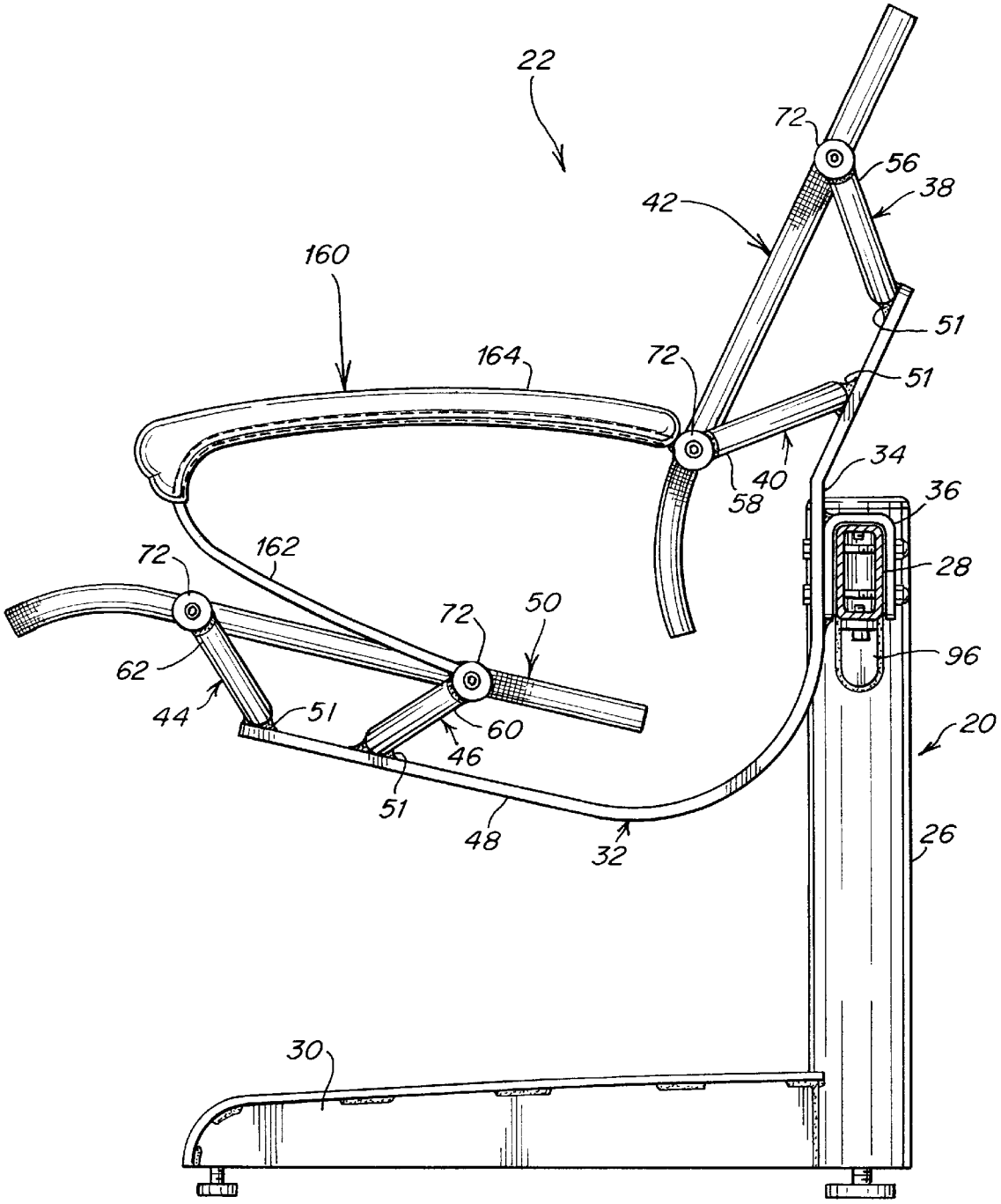
FIG. 4 is a cross-sectional side view of the assembly taken along section line 4—4 in FIG. 1.
Figure 5:
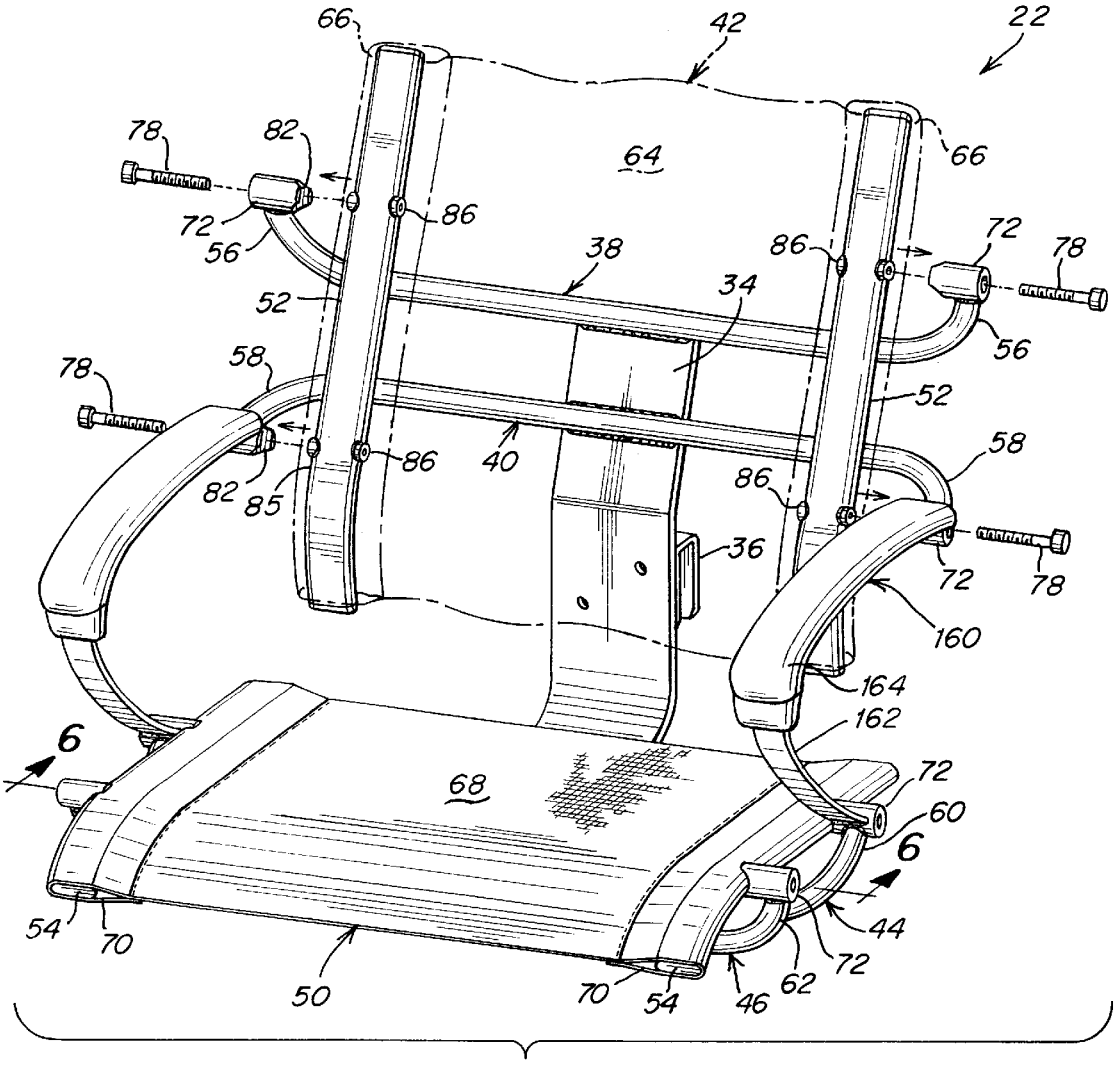
FIG. 5 is an exploded perspective view of one of the chairs used in the assembly of FIG. 1.

The frame 20 includes a pair of tubular posts 26, one at each end of the frame, that together support a horizontal rail 28. The posts are stabilized by forwardly extending feet 30, and the several chairs 22 and table 24 are all suspended on the rail 28 and disposed on the front side thereof. Each of the chairs 22 as shown in FIGS. 4 and 5 includes a spring steel, generally L-shaped plate 32 that defines the spine of the chair. The vertical portion 34 of the spring plate 32 carries a U-shaped bracket 36 that hooks onto the horizontal rail 28 as well as a pair of generally horizontal tubular stretchers 38 and 40 that carry the backrest 42 of the chair. A pair of similar horizontal stretchers 44 and 46 are carried by the generally horizontal portion 48 of the plate 32 and support the seat 50 of the chair. Each of the horizontal stretchers 38, 40, 44 and 46 preferably is welded to the plate 32 as suggested at 51 in FIG. 4 but may be attached by other means such as bolts, rivets or the like. The ends 56 and 58 of the stretchers 38 and 40 extend forwardly from the plane of the portion 34 of plate 32 and the ends 60 and 62 of the stretchers 44 and 46 extend upwardly from the plane of the portion 48 of the plate.

As shown in FIG. 5 the sides of the backrest 42 are defined by flat, oval tubing sections 52, and similar tubing sections 54 define the sides of the seat 50. The tubing sections 52 are, in turn, carried on the ends 56 and 58 of the stretchers 38 and 40, respectively, and the tubing sections 54 on each side area carried on the ends 60 and 62 of the stretchers 44 and 46, respectively. The details of the connections of the stretchers to the flat tubing sections are described below.

Both the backrest 42 and seat 50 of each chair is of the sling-type composed of a flexible material such as fabric or leather with each end formed into a loop that receives and surrounds the flat tubing sections. Thus, the backrest 42 is composed of a rectangular sheet 64 of fabric, leather or the like having loops 66 at each side edge that encircle the tubing 52 while the seat 50 is made of a rectangular sheet of similar material 68 having loops 70 along its side edges that surround the tubing 54. The curved ends of the stretchers 38, 40, 44 and 46 cause the sling seat and backrest to be spaced away from the steel plate 32.

Figure 6:
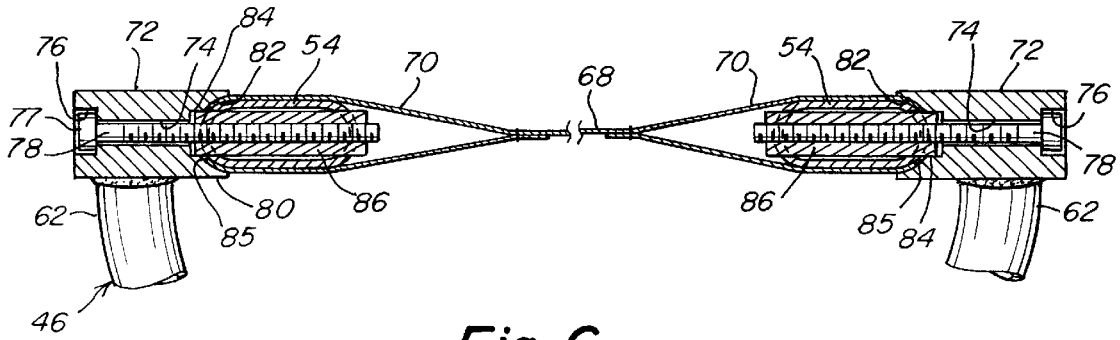
FIG. 6 is a cross-sectional view of the seat mounting details taken along the section line 6—6 in FIG. 5.

The flat oval tubing sections 52 and 54 preferably are 16 gauge steel or other material of comparable strength and contoured to provide both lumbar support and knee strain relief in the backrest and seat, respectively. As shown in FIGS. 5 and 6, the ends 56, 58, 60, and 62 of the stretchers 38, 40, 44 and 46 carry attachment sockets 72 that are welded in place, and each socket has a through hole 74 that is countersunk at 76 on its outside face to receive the head 77 of a bolt 78. The inside end 80 of each socket 72 has a curved seat 82 also countersunk as suggested at 84 to receive a curved side edge 85 of flat oval tubing 54 and an end of its internally threaded insert 86. Each insert 86 is brazed in place within its tubing section 52 or 54. The ends of the inserts are exposed through holes provided in the loops 66 and 70 of the backrest and seat material so that they may register directly with the countersinks 84 in the curved seats 82 of the sockets. As is clearly shown in FIG. 6, the bolts 78 are threaded into the inserts 86 and extend through attachment sockets 72 so as to essentially eliminate the bending moments on the bolt caused by one sitting on the seat 50 or leaning against the backrest. It is to be understood that the connection between the ends of the stretcher 46 and the tubing shown in FIG. 6 and described above is duplicated at each of the connections of the stretchers to the tubing so as to eliminate the bending moments exerted on the bolts 78 by the occupant of the chair sitting on the seat and/or leaning against the backrest 42.

Figure 7:
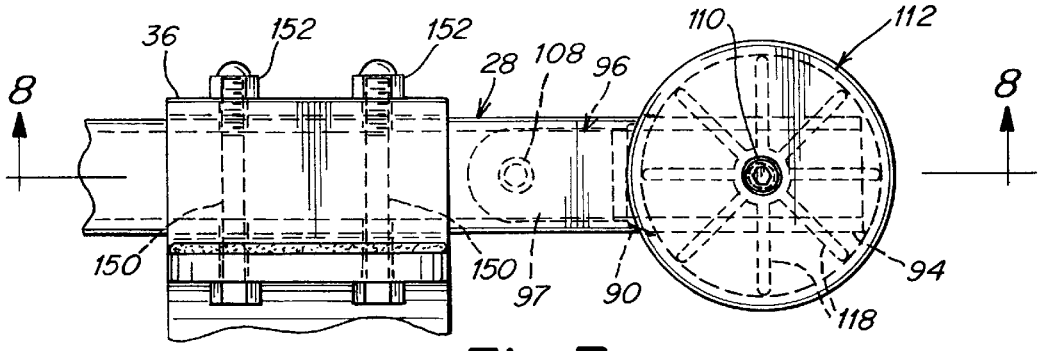
FIG. 7 is a fragmentary top plan view of the post and rail connection and of the hanger for the seats and table in the assembly shown in FIG. 1.
Figure 8:
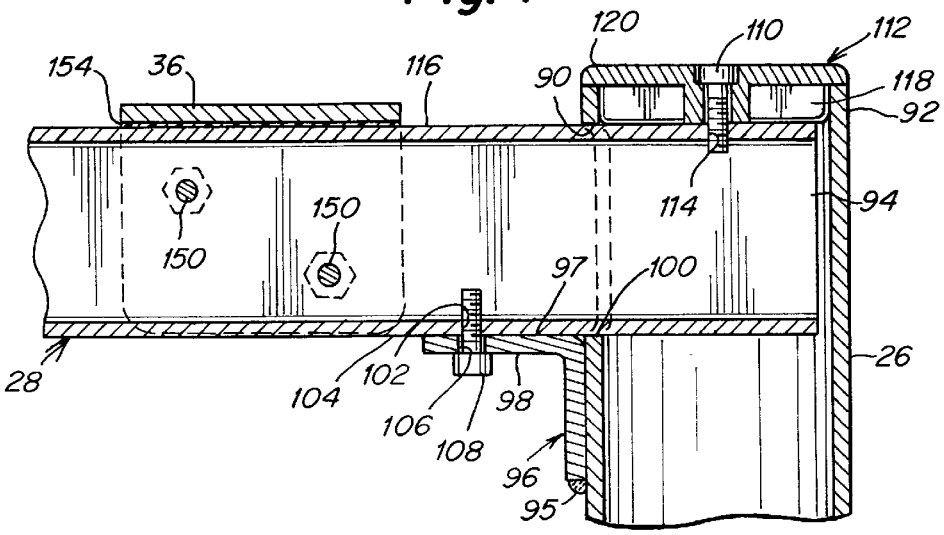
FIG. 8 is a fragmentary cross-sectional view of the post, rail and hanger connections taken along the section line 8—8 in FIG. 7.
Figure 9:
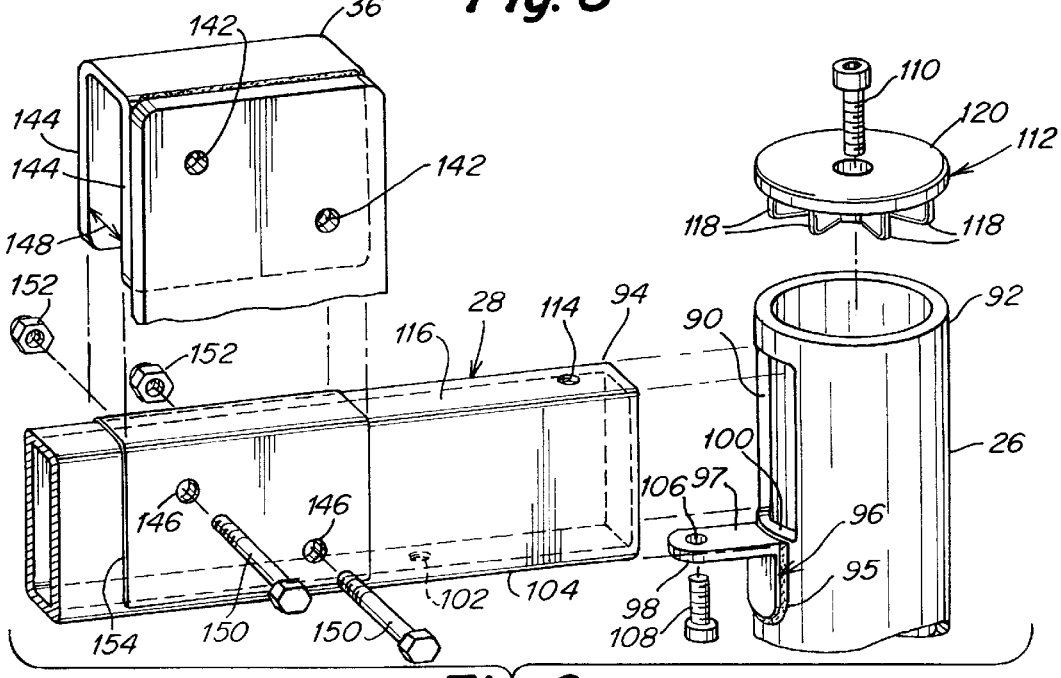
FIG. 9 is an exploded perspective view of the post, rail and hanger connections shown in FIGS. 7 and 8.

In FIGS. 7–9 the details of the connection between the tubular posts 26 and the rail 28 are shown as well as the details of the connection between the clamping brackets 36 and the rail 28. Each post 26 has a generally rectangular opening 90 adjacent its upper end 92, sized to receive an end 94 of the rail 28. An L-shaped support bracket 96 is welded as suggested at 95 to the outer surface of the post with the upper surface 97 of the horizontal arm 98 of the bracket coplanar with the lower edge 100 of the opening 90. When the end 94 of rail 28 is inserted in the opening 90, the rail rests on both the lower edge 100 of the opening and on the upper surface 97 of the bracket 96. A threaded hole 102 is provided in the bottom side 104 of the rail 28 and aligns with the hole 106 in the horizontal arm 98 of the bracket 96 when the end of the rail is in place in the post. To secure the rail in place, a threaded bolt 108 extends upwardly through the hole 106 and screws into the threaded hole 102, and a second bolt 110 extends through a cap 112 that closes the upper end of the post 26 and registers with a threaded hole 114 in the upper side 116 of the rail. The cap 112 may be an aluminum casting as shown in FIG. 9 and includes a number of radial ribs 118 on its lower surface that may engage the upper side 116 of the rail 28 and center the cap on the post. The diameter of the cap top wall 120 exceeds the inner diameter of the post 28 and sits on the upper edge of the post. The connections between the rail 28 and bracket 96 and between the rail 28 and the cap 112 stabilize the rail so that it is securely held in place. The same assembly is employed at each end of the rail 28 to connect it to the posts.

Figure 2:
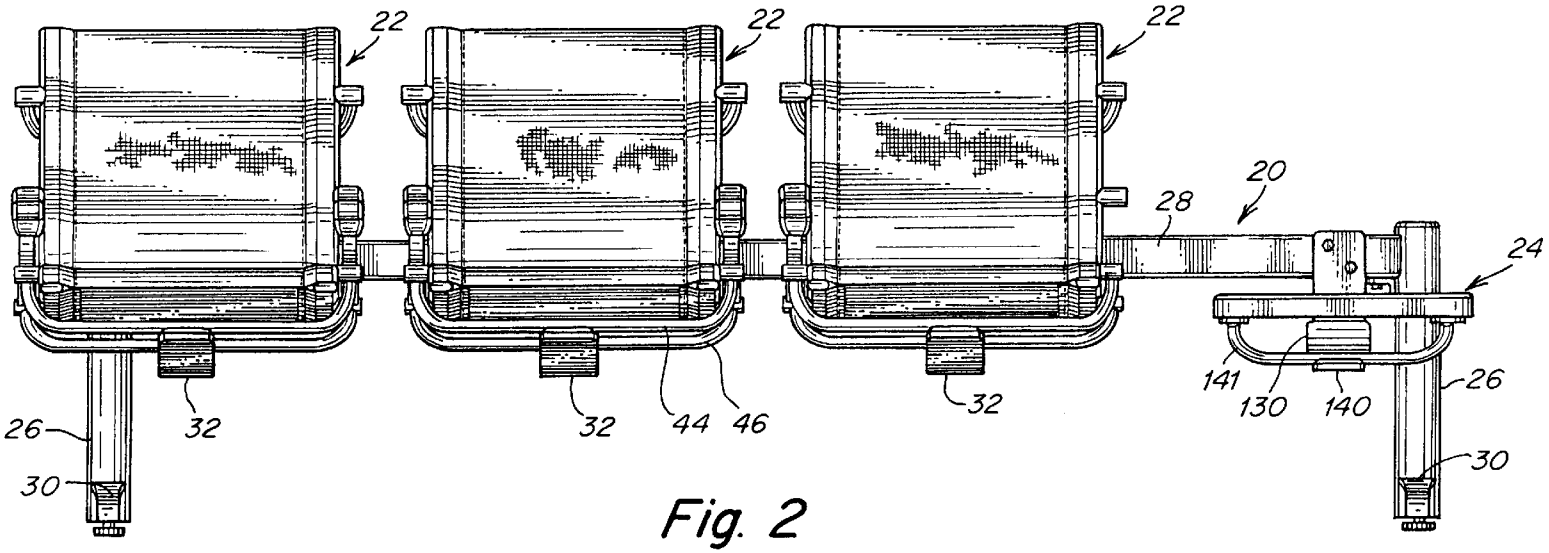
FIGS. 2 and 3 are front and rear elevation views, respectively of the assembly shown in FIG. 1.
Figure 3:
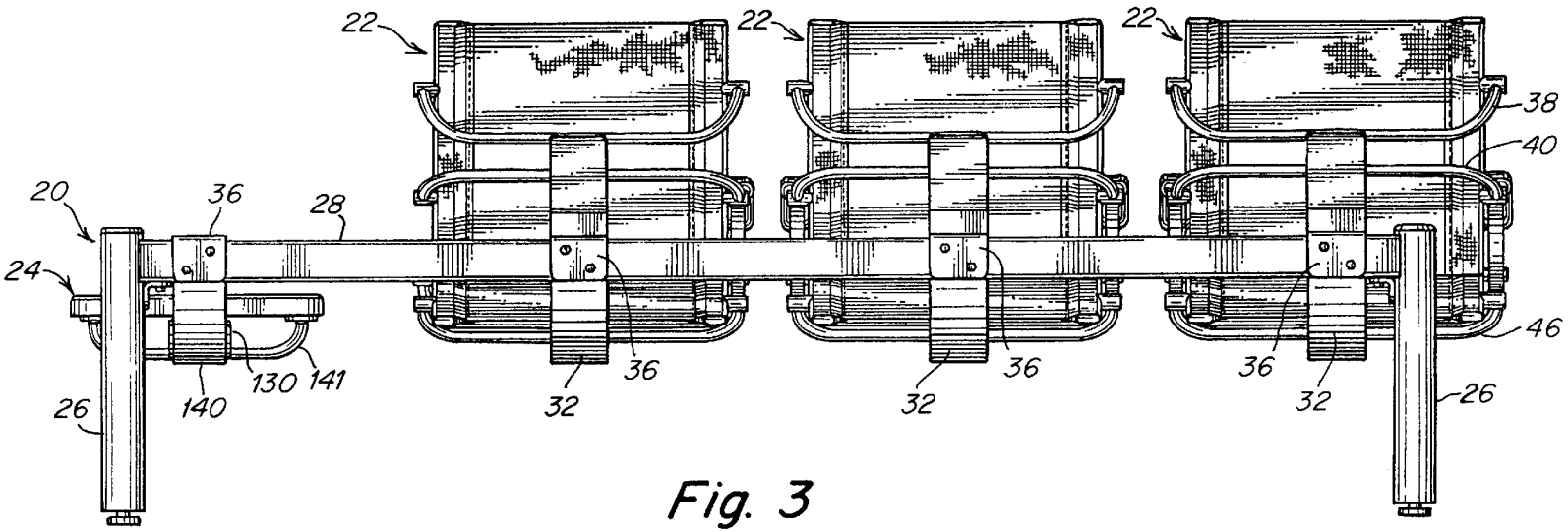

As described above, each of the chairs 22 and the table 24 is mounted on the rail 28 by a U-shaped bracket 36 that hooks onto the rail. The bracket 36 supporting each chair is welded to the vertical arm 34 of the spring plate 32 that serves as the spine of each chair. The bracket 36 supporting the table is welded to the plate 140 that in turn carries the bars 141 that support the table. A reinforcing plate 130 is attached to the plate 140 that carries the table, as is shown in FIGS. 2 and 3 to eliminate the spring action and prevent the table from sagging.

In FIGS. 7–9 two through holes 142 are shown provided in the vertical flanges 144 of the bracket 36, and two additional holes 146 extend through the two vertical side walls of the rail 28 and are spaced to align with the holes 142 when the bracket is positioned on the rail. The gap 148 between the vertical flanges 144 of the bracket 36 is selected to receive the rail 28, and machine screws 150 with cap nuts 152 are employed to pass through the aligned holes 142 and 146 to retain the bracket in position on the rail. Each bracket 36 for the chairs and table are attached to the rail in the same fashion as is evident in FIG. 3. In accordance with the present invention, a liner made of a polymeric material such as ultra high molecular weight polyethylene tape 154 or other similar material is placed on the rail so as to line the inside of the bracket 36 and thereby prevent rubbing of metal against metal (the rail 28 and bracket) that could cause squeaking when people sit in the chairs or place heavy objects on the table. Tape 1/32 inches in thickness is recommended for this purpose.

As shown in FIG. 1, one of the chairs 22 (positioned at the right end of the three) has a single armrest 160 while the other chairs in the group have two arms. The invention encompasses chairs with one, two or no arms. In the embodiment illustrated, the armrests are formed of solid metal straps 162 that are connected by welding or other means at one end to the attachment sockets 72 on the lower stretchers 40 in the backrests and at the other end to the rear attachment sockets 72 on the stretchers 44 of the seats. An armrest pad 164 is screwed to the top of each rigid strap to maximize the comfort provided the chair occupant by the armrest.

From the foregoing description, it will be appreciated that the multiple seating of this invention provides a number of advantages over prior art multiple seating presently available. First, a comfortable seat is provided that has some resiliency so that it can conform to the shape of the torso of the occupant while providing both lumbar support and knee strain relief. The manner in which the individual seats are assembled effectively eliminates the bending moments on the bolts 78 ordinarily exerted by the weight of the chair occupant. The leg rail attachment and particularly the connection between the posts 26 and the horizontal rail 28 on which the separate seat and table are mounted eliminates both torque and lateral movement of the assembly. In addition the clamping arrangement of the seats and table brackets 36 to the rail with the use of a polymeric material such as polyethylene eliminates noise that otherwise would be caused by metal to metal contact and allow greater tolerances at the connections.

The multiple seating of this application has numerous other advantages. Very apparent is the versatility of the construction which permits the arrangement of chairs and table or tables to be varied to accommodate the space to be occupied by the furniture. A variety of configurations of chairs and tables may be selected to fill particular needs. The construction is very rugged and therefore is able to withstand the heavy use to which such furniture is regularly subjected. The frame construction facilitates the repair or replacement of any of the parts of the assembly as the multi-seat unit may be disassembled and reassembled without difficulty. For example, the sling-type seats and backs may be replaced simply by detaching the stretchers 38, 40, 44 and 46 from the flat oval tubular members 52 and 54 and removing the old and applying the new sling-type seats and/or backrests. This is done merely by unscrewing the bolts 78 from the inserts 86. Another advantage of the invention is that the multiple seating can be shipped disassembled and be assembled at the site of use.

Those skilled in the art will appreciate that numerous modifications may be made of this invention without departing from the spirit of the invention. Therefore, it is not intended that the scope of the invention be limited to the single embodiment illustrated and described. Rather its scope is to be determined by the appended claims and their equivalents.

What is claimed is:

1. A multiple seating assembly comprising:

a horizontal rail supported at each end in an elevated plane;

at least one seating unit having a seat and backrest mounted on the rail, said seating unit including (a) a plate having substantially vertical and horizontal portions for respectively supporting the backrest and seat, (b) a pair of horizontal stretchers secured to and extending to the sides of the vertical portion and a pair of horizontal stretchers secured to and extending to the sides of the horizontal portion of the plate, (c) sockets secured to both ends of each of the stretchers and arranged in pairs on each side of the seating, (d) through holes in each of the sockets and extending generally horizontally in a direction transverse to the seating unit, (e) tubular sections defining lateral sides of the backrest and seat, and engaging the sockets on their respective sides, (f) inserts secured in each of the tubular sections and having threaded holes for alignment with the through holes in the inserts, (g) bolts extending through the holes in the sockets and screwed into the threaded holes in the inserts to secure the tubular sections to the sockets, (h) and sling-type flexible material mounted on the tubular sections to form the seating and back of the seat and backrest.

2. A multiple seating assembly as defined in claim 1 wherein the engagement of the sockets and tubular sections forms an interface of matching contours.

3. A multiple seating assembly as defined in claim 1 wherein the tubular sections are flat oval metal tubing.

4. A multiple seating assembly as defined in claim 1 wherein the inserts are brazed in the tubular sections.

5. A multiple seating assembly as defined in claim 2 wherein the tubular sections are flat oval metal tubing.

6. A seating unit comprising;

a metal spring-like plate having generally horizontal and vertical portions for respectively supporting a seat and backrest, each having lateral sides, a pair of generally vertical tubular members defining the lateral sides of the backrest and a pair of generally horizontal tubular members defining the lateral sides of the seat, a pair of stretchers secured to the horizontal portion of the plate and a pair of stretchers secured to the vertical portion of the plate, ends of the stretchers connected to the tubular members to support the members in their respective lateral positions for the backrest and seat, and a sheet of material secured between the tubular members defining the sides of the backrest and a second sheet of material secured between the tubular members defining the sides of the seat, said sheets forming the supporting surfaces of the seat and backrest.

7. A seating unit as defined in claim 6 wherein the connection between each of the ends of the stretchers and the tubular members includes an insert mounted in the tubular member and a socket mounted on the end of the stretcher, and a bolt detachably joining the insert to the socket.

8. A seating unit as defined in claim 7 wherein the socket includes a contoured surface to interface with a side of the tubular member.

9. A seating unit as defined in claim 6 wherein each of the stretchers has ends that extend away from the plane of the portion of the plate to which it is secured so as to hold the supporting surfaces of the seat above the horizontal portion of the plate and the supporting surface of the backrest in front of the vertical portion of the plate.

* * * * *